United States Patent [19]

Broze et al.

[11] Patent Number: 4,749,512

[45] Date of Patent: Jun. 7, 1988

[54] LIQUID LAUNDRY DETERGENT COMPOSITION

[75] Inventors: Guy Broze, Grace-Hollogne; Danielle Bastin, Soumagne; Leopold Laitem, Orp-Jauche, all of Belgium

[73] Assignee: Colgate-Palmolive Company, New York, N.Y.

[21] Appl. No.: 926,851

[22] Filed: Nov. 3, 1986

Related U.S. Application Data

[63] Continuation of Ser. No. 814,528, Dec. 19, 1985, abandoned, which is a continuation of Ser. No. 597,948, Apr. 9, 1984, abandoned.

[51] Int. Cl.[4] ..... C11D 1/83

[52] U.S. Cl. ..... 252/174.18; 252/99; 252/135; 252/174.21; 252/186.38; 252/525; 252/544; 252/DIG. 14

[58] Field of Search ..... 252/89.1, 99, 100, 135, 252/136, 174.18, 174.21, 174.24, 186.38, DIG. 14; 560/198

[56] References Cited

U.S. PATENT DOCUMENTS

| | | | |
|---|---|---|---|
| 3,594,409 | 7/1971 | LaChampt | 560/198 |
| 3,741,911 | 6/1973 | Shane | 252/174.21 |
| 3,775,052 | 11/1973 | Van Paassen | 252/89.1 |
| 3,896,040 | 7/1975 | Danesh | 252/174.21 |
| 4,306,997 | 12/1981 | Oneto et al. | 252/174.21 |
| 4,316,812 | 2/1982 | Hancock et al. | 252/99 |

FOREIGN PATENT DOCUMENTS

| | | |
|---|---|---|
| 36643 | 11/1975 | Japan . |
| 1270040 | 4/1972 | United Kingdom . |

*Primary Examiner*—Paul Lieberman
*Assistant Examiner*—Hoa Van Le
*Attorney, Agent, or Firm*—M. M. Grill; N. Blumenkopf

[57] ABSTRACT

A liquid heavy duty laundry detergent composition comprising a suspension of builder salt in liquid nonionic surfactant. To improve dispensibility in automatic washing machines, the composition contains also a nonionic surfactant which has been modified to convert a free OH group thereof to a moiety having a COOH group, e.g., by reaction withh succinic anhydride.

13 Claims, No Drawings

LIQUID LAUNDRY DETERGENT COMPOSITION

This application is a continuation of application Ser. No. 814,528 filed Dec. 19, 1985, which in turn is a continuation of U.S. Ser. No. 597,948, filed Apr. 9, 1984, both abandoned.

This invention relates to liquid laundry detergent compositions.

Liquid nonaqueous heavy duty laundry detergent compositions are well known in the art. For instance, compositions of that type may comprise a liquid nonionic surfactant in which are dispersed particles of a builder, as shown for instance in the U.S. Pat. Nos. 4,316,812; 3,630,929; 4,264,466, and British Pat. Nos. 1,205,711 and 1,270,040.

In the ordinary use of European household automatic washing machines, the user places the laundry detergent composition in a dispensing unit (e.g., a dispensing drawer) of the machine. Then during the operation of the machine, the detergent in the dispenser is subjected to a stream of cold water to transfer it to the main body of wash solutions. In winter, when the detergent composition and the water fed to the dispenser are cold, there can be problems in that some of the composition is not flushed completely off the dispenser during operation of the machine, and a deposit of the composition builds up with repeated wash cycles, so that it may become necessary for the user to flush the dispenser with hot water.

One reason for this problem involves the behavior of the nonionic surfactant when mixed with cold water. Its viscosity increases markedly and a gel is formed. As a result, the detergent composition does not flow readily or completely from the dispenser.

It has now been found that the flow from the dispenser can be improved considerably by including in the liquid detergent composition a nonionic surfactant which has been modified to convert a free hydroxyl group thereof to a moiety having a free carboxyl group. Such a compound may be formed, for instance, by reacting a nonionic surfactant with a polycarboxylic acid anhydride, such as succinic anhydride, to form a partial ester of the polycarboxylic acid. The resulting acidic compound will react, in the wash bath, with the alkalinity of the detergent composition and acts as an effective anionic surfactant.

The invention is illustrated further by the following examples:

EXAMPLE 1

400 g. of a nonionic surfactant which is a $C_{13}$ to $C_{15}$ alkanol which has been alkoxylated to introduce 6 ethylene oxide and 3 propylene oxide units per alkanol unit is mixed with 32 g. of succinic anhydride and heated for 7 hours at 100° C. The mixture in then cooled and filtered to remove unreacted succinic material. Infrared analysis indicates that about one half of the nonionic surfactant has been converted to the acidic half ester thereof. Viscosities and gel temperatures of the product as compared to the unmodified nonionic surfactant are given below:

| | Product | Unmodified Nonionic Surfactant |
|---|---|---|
| Viscosity at 20° C. | 138 cps | 60 cps |
| Gel temperature of a 40/60 mixture with water (i.e. mixture containing 60% water) | 7° C. | 20° C. |
| Viscosity of the 40/60 mixture with water | | |
| at 25° C. | 60 cps | 189 cps |
| at 20° C. | 100 cps | 445 cps |

It will be seen that even though the product (which, as previously indicated, is a mixture of about equal parts of unmodified nonionic surfactant and acidic half ester thereof) has a higher viscosity than the unmodified surfactant, its viscosity on dilution with water is considerably lower, as is its gelling temperature.

EXAMPLE 2

522 g. of the nonionic surfactant known as Dobanol 25-7 (the product of ethoxylation of a $C_{12}$ to $C_{15}$ alkanol, which product has about 7 ethyleneoxide units per molecule of alkanol) is mixed with 100 g. of succinic anhydride and 0.1 g. of pyridine (which acts as an esterification catalyst here) and heated at 60° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

EXAMPLE 3

Example 2 is repeated using 1000 g. of Dobanol 91-5 (the product of ethoxylation of a $C_9$ to $C_{11}$ alkanol, which product has about 5 ethylene oxide units per molecule of alkanol) and 265 g. succinic anhydride.

EXAMPLE 4

A liqhid nonaqueous heavy duty laundry detergent is formulated from the following ingredients, in the proportions specified.

35% nonionic surfactant comprising a mixture of equal parts of:

(a) a relatively water soluble nonionic surfactant which forms a gel when mixed with water at 25° C., specifically a $C_{13}$ to $C_{15}$ alkanol which has been alkoxylated to introduce 10 ethylene oxide and 5 propylene oxide units per alkanol unit and (b) a less water-soluble nonionic surfactant, specifically a $C_{13}$ to $C_{15}$ alkanol which has been alkoxylated to introduce 4 ethylene oxide and 7 propylene oxide units per alkanol unit.

12% of the product of Example 3.

31.2% sodium tripolyphosphate.

9% sodium perborate monohydrate.

4.5% tetraacetyl ethylene diamine; this is an activator for the sodium perborate.

4% copolymer of about equal moles of methacrylic acid and maleic anhydride, completely neutralized to form the sodium salt thereof (Sokalan CP5); this serves to inhibit incrustation (as from formation of dicalcium phosphate).

1% sodium salt of diethylene triamine pentamethylene phosphonic acid (DTPMP).

1% Proteolytic enzyme slurry (in nonionic surfactant) (Esperase)

1% mixture of sodium carboxymethylcellulose and hydroxymethylcellulose (an antiredeposition agent) (Relatin DM4096).

0.5% perfume 0.5% optical brightener (of stilbene 4 type)

0.3% partial ester of phosphoric acid and a $C_{16}$ to $C_{18}$ alkanol (Empiphos 5632, in which there is about $\frac{1}{3}$ monoester and $\frac{2}{3}$ diester)

The ingredients are mixed together, with the phosphoric ester and then the sodium tripolyphosphate being preferably added last, and passed through a colloid mill to reduce the particle size of the solid materials to less than 100 microns (e.g. to about 40 microsn). The mixture is then subjected to ginding to reduce the sizes of the suspended solid particles to less than 10 microns (e.g. to in the range of about 2 to 10 microns with less than about 10% of the solids having particle sizes above about 10 microns).

The ingredients and conditions are chosen so that the total unbound water content of the composition is less thant 2%, preferably less than 1%, such as about ½% or less.

The mixture has a high viscosity, but dispenses readily with cold water in the automatic washing machine. Its specific gravity is about 1.25. It gives excellent washing when used at a dosage of about 100 grams per wash load (as compared with 170 grams per wash load for the usual heavy duty laundry detergent powders) in conventional European home laundry machines (which employ about 20 liters of water for the washing bath).

In the foregoing Examples, there is a carboxylic acid moiety joined to the residue of the nonionic surfactant by a carboxylic ester linkage. Instead of a succinic acid moiety, other polycarboxylic acid moieties may be used, e.g. maleic, glutaric, malonic, phthalic, citric, etc. In broader aspects of the invention, other linkages may be used, such as ether, thioether or urethane linkages, formed by conventional reactions. For instance, to form an ether linkage, the nonionic surfactant may be treated with a strong base (to convert its OH group to an ONa group for instance) and then reacted with a halocarboxylic acid such as chloroacetic acid or chloropropionic acid or the corresponding bromo compound. Thus the resulting carboxylic acid may have the formula R—Y—ZCOOH where R is the residue of a nonionic surfactant (on removal of a terminal OH), Y is oxygen or sulfur and Z represents an organic linkage such as a hydrocarbon group of say, one to ten carbon atoms which may be attached to the oxygen (or sulfur) of the formula directly or by means of an intervening linkage such as an oxygen-containing linkage, e.g. a $$-\overset{\overset{\displaystyle O}{\|}}{C}- \quad \text{or} \quad -\overset{\overset{\displaystyle O}{\|}}{C}-NH-,$$

(i.e., carbonyl or caboximido, respectively).

In another aspect of the invention, the carboxylic acid may be produced from a polyether which is not a nonionic surfactant, e.g., it may be made by reaction with a polyalkoxy compound such as polyethylene glycol or a monoester or monether thereof which does not have the long alkyl chain characteristic of the nonionic surfactants. Thus, R may have the formula $R^1(OCH—CH_2)_n—$ where $R^2$ is hydrogen or methyl, $R^1$ is alkylphenyl or alkyl or other chain terminating group and "n" is at least 3 such as 5 to 25. When the alkyl of $R^1$ is a higher alkyl, R is a residue of a nonionic surfactant. As indicated above $R^1$ may instead by hydrogen or lower alkyl (e.g. methyl, ethyl, propyl, butyl) or lower acyl (e.g. acetyl, etc.). The acidic polyether compound is preferably present, in the detergent composition, as a solution in the nonionic surfactant.

The carboxylic used may also be a polyalkoxycarboxylate or N-acyl sarcosinate as described and listed in Kirk-Othmer, "Encyclopedia of Chemical Technology", 3rd Edition, Vol. 22 (1983), Pages 348–349.

As is will known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929, as well as those described and listed in the discussion on non-ionic surfactants in Kirk-Othmer "Encyclopedia of Chemical Technology", 3rd Edition, Vol. 22 (1983), Pages 360–379.

The compositions preferably contain fine particles of a detergent builder dispersed in the nonionic surfactant. Among the suitable builders are inorganic and organic builder salts such as the phosphates, carbonates, silicates, phosphonates, polyhydroxysulfonates, polycarboxylates and the like. Typical suitable builders are those disclosed in U.S. Pat. Nos. 4,316,812; 4,264,466; and 3,630,929.

Since, as indicated in Example 4, the compositions of this invention may be used at relatively low dosages, it is desirable to supplement any phosphate builder (such as sodium tripolyphosphate) with an auxiliary builder such as a polymeric carboxylic acid having high calcium binding capacity, in amount in the range, for instance, of about 1 to 10% of the composition, to inhibit incrustation which could otherwise be caused by formation of an insoluble calcium phosphate. Such auxiliary builders are well known in the art.

The composition preferably comprises a peroxygen bleaching agent. This may be a peroxygen compound, such as an alkali metal perborate, percarbonate or perphosphate; a particularly suitable material is sodium perborate monohydrate. The peroxygen compound is preferably used in admixture with an activator therefor. Suitable activators are those disclosed in U.S. Pat. No. 4,264,466 or in column 1 of U.S. Pat. No. 4,430,244. Polyacylated compounds are preferred activators; among these, compounds such as tetraacetyl ethylene diamine ("TAED") and pentaacetyl glucose are particularly preferred.

The activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Such a sequestering agent is an organic compound which is able to form a complex with $Cu^{2+}$ ions, such that the stability constant (pK) of the complexation is equal to or greater than 6, at 25° C., in water, of an ionic strength of 0.1 mole/liter, pK being conventionally defined by the formula: pK = −log K where K represents the equilibrium constant. Thus, for example, the pK values for complexation of copper ion with NTA and EDTA at the stated conditions are 12.7 and 18.8, respectively. Suitable sequestering agents include the sodium salts of nitrilotriacetic acid (NTA); ethylene diamine tetraacetic acid (EDTA); diethylene triamine pentaacetic acid (DETPA); diethylene triamine pentamethylene phosphonic acid (DTPMP); and ethylene diamine tetramethylene phosphonic acid (EDITEMPA).

Other ingredients which may be included in the composition are enzymes (e.g. proteases, amylases or lipases or mixtures thereof), optical brighteners, antiredeposition agents, colorants (e.g. pigments or dyes) etc.

The composition may also contain an inorganic insoluble thickening agent or dispersant of very high surface area such as finely divided silica of extremely fine particle size (e.g. of 5–100 millimicrons diameter such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In a preferred form of the invention the mixture of liquid nonionic surfactant and solid ingredients is subjected to an attrition type of mill in which the particle sizes of the solid ingredients are reduced to less than about 10 microns, e.g., to an average particle size of 2 to 10 microns or even lower (e.g., 1 micron). Compositions whose dispersed particles are of such small size have improved stability against separation or settling on storage. It is found that the acidic polyether compound can decrease the yield stress of such dispersions, aiding in their dispensibility, without a corresponding decrease in their stability against settling.

The mixture may contain anti-settling ingredients such as a partial ester of phosphoric acid and a higher alkanol, present in small amounts such as less than 1%, e.g., below ½%, during the grinding. Other phosphate ester surfactants may be used instead such as those described and listed in Kirk-Othmer "Encyclopedia of Chemical Technology", 3rd Edition, Vol. 22(1983), Pages 359–361.

In the grinding operation it is preferred that the proportion of solid ingredients be high enough (e.g., at least about 40% such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm. or 1.5 mm diameter grinding balls working in a very small gap between a stator and a rotor operating at a relatively high speed (e.g., a CoBall mill) may be employed; when using such a mill, it is desirable to pass the blend of nonionic surfactant and solids first through a mill which does not effect such fine grinding (e.g., a colloid mill) to reduce the particle size to less than 100 microns (e.g., to about 40 microns) prior to the step of grinding to an average particle diameter below about 10 microns in the continuous ball mill.

In the compositions of the invention, typical proportions of the ingredients are as follows:

Suspended detergent builder, within the range of about 10 to 60% such as about 20 to 50%, e.g., about 25 to 40%;

Liquid phase comprising nonionic surfactant and dissolved carboxylic acid gel-inhibiting compound, wihtin the range of about 30 to 70%, such as about 40 to 60%; this phase may also include a diluent such as a glycol, e.g., polyethylene glycol (e.g., "PEG 400") or hexylene glycol.

Carboxylic acid gel-inhibiting compound, an amount to supply in the range of about 0.5 to 10 parts (e.g., about 1 to 6 parts such as about 2 to 5 parts) of —COOH (M.W. 45) per 100 parts of blend of such acid compound and nonionic surfactant. (In Example 4 there are about 3 parts of COOH per 100 parts of such blend). Typically, the amount of the carboxylic acid compound is in the range of about 0.01 to 1 part per part of nonioic surfactant, such as about 0.05 to 0.6 part, e.g., about 0.2 to 0.5 part;

Peroxygen compound (such as sodium perborate monohydrate) in the range of about 2 to 15%, such as about 4 to 10%;

Activator, in the range of about 1 to 8%, such as about 3 to 6%.

A sequestering agent of high complexing power, in the range of abour ¼ to 3%, such as about ½ to 2%.

In this application all proportions are by weight unless other wise indicated. In the Examples, atmospheric pressure is used unless other wise indicated.

It is understood that the foregoing detailed description is given merely by way of illustration and that variations may be made therein without departing from the spirit of the invention.

We claim:

1. A substantially non-aqueous liquid heavy duty laundry detergent composition comprising a suspension of builder salt in a liquid nonionic surfactant, said composition containing a polyether carboxylic acid in an amount effective to decrease the temperature at which said surfactant forms a gel with water, and in which the proportion of said polyether carboxylic acid is such as to provide about 0.5 to 10 parts of —COOH per 100 parts of the mixture of said polyether carboxylic acid, wherein an ester linkage attached to polyether group and said nonionic surfactant.

2. A composition as in claim 1 in which said polyether carboxylic acid is soluble in said nonionic surfactant and said composition is substantially nonaqueous.

3. A composition as in claim 1 in which said polyether carboxylic acid contains a grouping of the formula $$-(\underset{\underset{R^2}{|}}{OCH}-CH_2)_n-Y-Z-COOH$$

where $R^2$ is hydrogen or methyl, Y is oxygen or sulfur and Z is an organic linkage.

4. A composition as in claim 1 in which said polyether carboxylic acid is a half ester of a dicarboxylic acid and a nonionic surfactant.

5. A composition as in claim 1 in which the particle size of the suspended builder salt is below about 10 microns.

6. A substantially non-aqueous liquid heavy duty laundry detergent composition comprising a suspension of a builder salt in a liquid nonionic surfactant, said composition containing also a compound comprising nonionic surfactant in which a hydrogen atom has been replaced by a group having a free COOH, said compound being present in an amount effective to decrease the temperature at which the nonionic surfactant forms a gel with water, said amount being such as to provide about 0.5 to 10 parts of —COOH per 100 parts of the mixture of said compound and said liquid nonionic surfactant.

7. A composition as in claim 6 in which said compound is a partial ester of a nonionic surfactant and a polycarboxylic acid.

8. A composition as in claim 7 in which said polycarboxylic acid is succinic acid.

9. A composition as in claim 7 in which said compound is a partial ester of a polycarboxylic acid and a polyethoxylated higher alkanol.

10. A composition as in claim 6 in which said builder salt is an alkali metal polyphosphate.

11. A composition as in claim 6 containing also suspended peroxygen bleaching agent.

12. A composition as in claim 11 in which said bleaching agent comprises sodium perborate monohydrate and an activator therefor.

13. A composition as in claim 11 in which said activator comprises tetraacetyl ethylene diamine.

* * * * *